US005918334A

United States Patent [19]

Laidlaw

[11] Patent Number: 5,918,334

[45] Date of Patent: Jul. 6, 1999

[54] CUSHION WITH GEL SAC AND GEL OVERLAY

[75] Inventor: Colin A. Laidlaw, Carmathen, United Kingdom

[73] Assignee: Medical Support Systems Limited, United Kingdom

[21] Appl. No.: 08/908,566

[22] Filed: Aug. 8, 1997

[30] Foreign Application Priority Data

Jun. 3, 1997 [GB] United Kingdom ..... 9711276

[51] Int. Cl.[6] ..... A47C 27/18; A47C 7/02

[52] U.S. Cl. ..... 5/654; 5/909; 297/452.25; 297/452.41

[58] Field of Search ..... 5/654, 653, 655.5, 5/909; 297/452.25, 452.41

[56] References Cited

U.S. PATENT DOCUMENTS

| | | | |
|---|---|---|---|
| D. 375,869 | 11/1996 | Bigolin | D6/601 |
| 3,253,861 | 5/1966 | Howard | 297/453 |
| 3,393,012 | 7/1968 | Chancellor, Jr. | 5/653 |
| 3,463,547 | 8/1969 | Brennan et al. | 297/459 |
| 3,503,649 | 3/1970 | Johnson | 297/459 |
| 3,663,973 | 5/1972 | Spence | 5/655.5 |
| 3,689,948 | 9/1972 | Graves et al. | 5/654 |
| 3,689,949 | 9/1972 | Weinstein et al. | 297/DIG. 3 |
| 4,312,087 | 1/1982 | De Geus | 5/490 |
| 4,709,431 | 12/1987 | Shaktman | 5/653 |
| 4,835,801 | 6/1989 | Walpin et al. | 297/DIG. 7 |
| 5,018,790 | 5/1991 | Jay | 5/654 |
| 5,044,030 | 9/1991 | Balaton | 5/654 |
| 5,189,747 | 3/1993 | Mundy et al. | 5/654 |
| 5,395,162 | 3/1995 | Jay et al. | 297/452.25 |

FOREIGN PATENT DOCUMENTS

| | | |
|---|---|---|
| 0 142 201 | 11/1984 | European Pat. Off. . |
| 0 258 952 | 9/1987 | European Pat. Off. . |
| 0 318 730 | 11/1988 | European Pat. Off. . |
| 0 318 731 | 11/1988 | European Pat. Off. . |
| 0 511 570A1 | 4/1989 | European Pat. Off. . |
| WO 87/07126 | 5/1987 | WIPO . |
| WO 89/05110 | 11/1988 | WIPO . |
| WO 93/03195 | 3/1992 | WIPO . |
| WO 91/17684 | 12/1993 | WIPO . |
| WO 95/07643 | 12/1993 | WIPO . |
| WO 95/05106 | 8/1994 | WIPO . |

OTHER PUBLICATIONS

Zero Gravity Medical; The Z–Flow Floam–Filled Cushion; Date Unkown; Product Flyer.

Medical Products; Varilite Pro–Form Seating System; 1993; Product Flyer.

Vision Wheelchair Seating Systems, Inc.; The VIP Cushion; Date Unknown; Product Flyer.

Special Health Systems; The Ulti–MAte Pressure–Relief Cushion; Date Unknown; Product Flyer.

Special Health Systems; Comfort Mate; Date Unknown; Product Flyer.

Avanti Personal Seat III & IV; Date Unknown; Product Brochure.

Avanti Essential, SDC & Contour Plus Cushions; Aug. 1995; Product Brochure.

Zero Gravity; The Cloud Fluid–Filled Cushion Featuring Floam 1995; Product Brochure.

*Primary Examiner*—Alex Grosz

*Attorney, Agent, or Firm*—King and Schickli

[57] ABSTRACT

A cushion, generally indicated, comprises a foam portion and a gel portion. The foam portion has a rear section defining a cavity, while the front section is shaped to support the users' thighs. The gel portion comprise a gel sac, which substantially fills the cavity and an overlay that extends over the gel sac and the front section of foam. The overlay is attached to the bag to maintain their relative portions, but gel cannot flow between them.

8 Claims, 3 Drawing Sheets

CUSHION WITH GEL SAC AND GEL OVERLAY

This invention relates to pressure relief cushions and in particular, but not exclusively, to cushions which are suitable for wheel chair users.

It has long been known that the people, who have to spend a substantial portion of their life sitting, can develop very painful pressure sores and there are many designs of cushions which attempt to relieve the pressure that creates those sores. One solution has been to provide a foam cushion with a cavity in its rear section for receiving a gel sac and this works quite well for normal patients, but is not totally satisfactory for wheel chair users, because they generally like to have a cushion which is much less deep. In those circumstances there is little foam under the gel sac and the sac and the foam are insufficient to provide proper pressure relief between the user and the hard surface of the wheel chair. This is particularly because the gel is fairly readily pushed to one side. Another approach is to provide a very substantial gel bag on an essentially rigid base so that the sac provides the complete seating surface. However this is not particularly comfortable, because it allows for no variation in support for the different parts of the body and because the material of the sac tends to become rucked up.

From one aspect the invention consists in a pressure relief cushion comprising a foam base having a cavity in its rear section opening into its upper surface and a front section for supporting the users' thigh; and a gel sac disposed in the cavity characterised in that the cushion further comprises a gel overlay connected to the sac but not in gel communication with it. The applicants have determined, surprisingly, that by in effect forming the gel sac as two separate individual sacs, one overlying the other, the effect of "bottoming out", wherein the ischial tuberosities effectively contact the bottom of the cavity, is removed. This is true even where the upper sac or overlay is thin, for example less than a centimeter deep. Conveniently both the overlay and the sac can be contained within an outer bag and the two may be welded together or otherwise fixed to each other. The overlay may further extend over the front section and may be provided with restrictions to inhibit the flow of gel through the overlay.

The cushion may be 7 to 9 cms in depth and may have a cavity which is between 4.5 and 5.5 cms deep at its deepest point.

Preferably the foam is resilient and the foam of the front section may be shaped to provide pressure relieving areas and/or appropriate support.

Although the invention has been defined above, it is to be understood it includes any inventive combination of the features set out above or in the following description.

The invention may be performed in various ways and a specific embodiment will now be described, by way of example with reference to the accompanying drawings. The file of this patent contains at least one drawing executed in color. Copies of this patent with color drawings(s) will be provided by the Patent and Trademark Office upon request and payment of the necessary fee.

Figure 1:
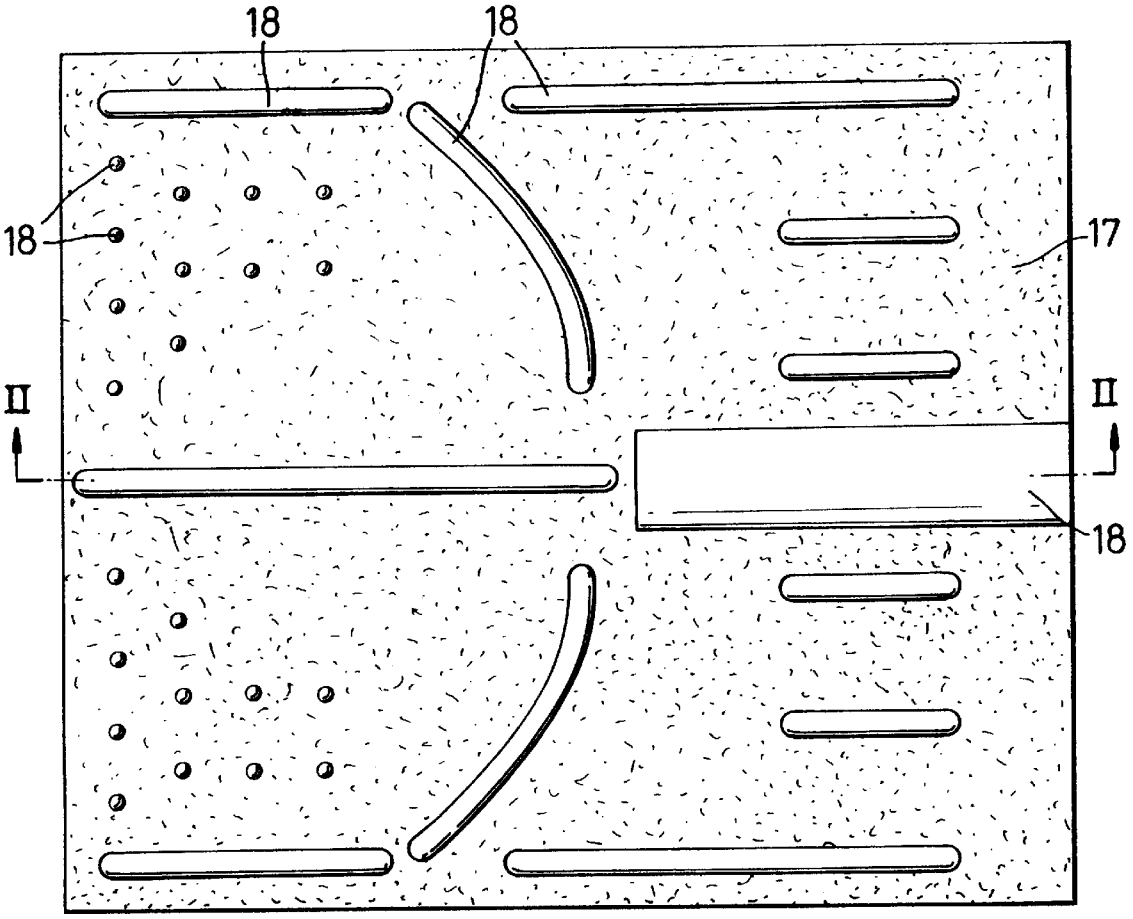
FIG. 1 is a view from above of a cushion.
Figure 2:
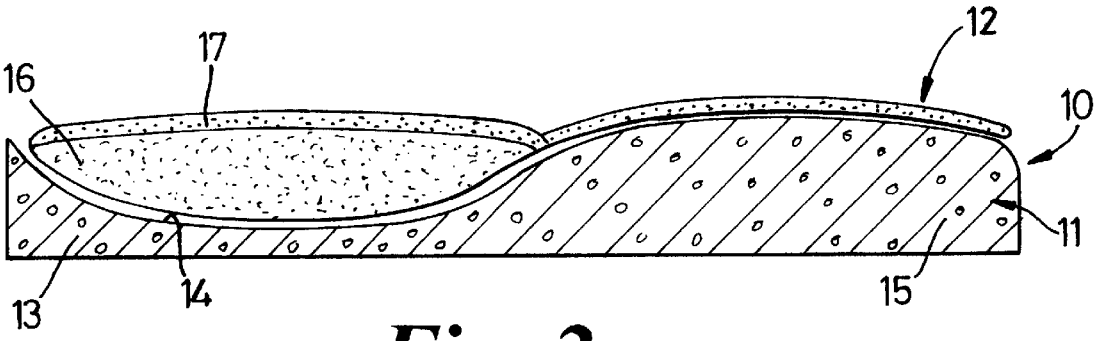
FIG. 2 is a section along the line II—II.

A cushion, generally indicated at 10, comprises a foam portion 11 and a gel portion 12. The foam portion 11 has a rear section 13 defining a cavity 14, whilst the front section 15 is shaped to support the users' thighs (much in the shape of the front of a tractor seat) and has pressure relief cutouts (not shown).

The gel section 12 comprises a gel sac 16, which substantially fills the cavity, and an gel-filled overlay 17 that extends over both the gel sac 16 and the front section of the foam 15. The overlay 17 is attached to the bag 16 to maintain their relative positions, but is not in gel communication with it ie. gel cannot flow between them. As can be seen in FIG. 1, the overlay is provided with a variety of restrictions 18, formed by welds in the plastic cover of the overlay. These restrictions 18 serve to inhibit the flow of gel through the overlay.

As has been mentioned already, the combination of a thin overlay 17 on top of the sac 16, surprisingly improves the performance of the cushion and enables a cushion of suitable depth to be provided for wheel chair users. Thus the cushion of the invention is preferably 8 centimeters deep and may be in the range of 7 to 9 centimeters. In that case the cavity is preferably 5 centimeters deep but may be in the range, for example, 4.5 to 5.5 centimeters. It will be understood that the front part of the overlay 17 adds to comfort, but is not essential to the invention.

Figure 3:
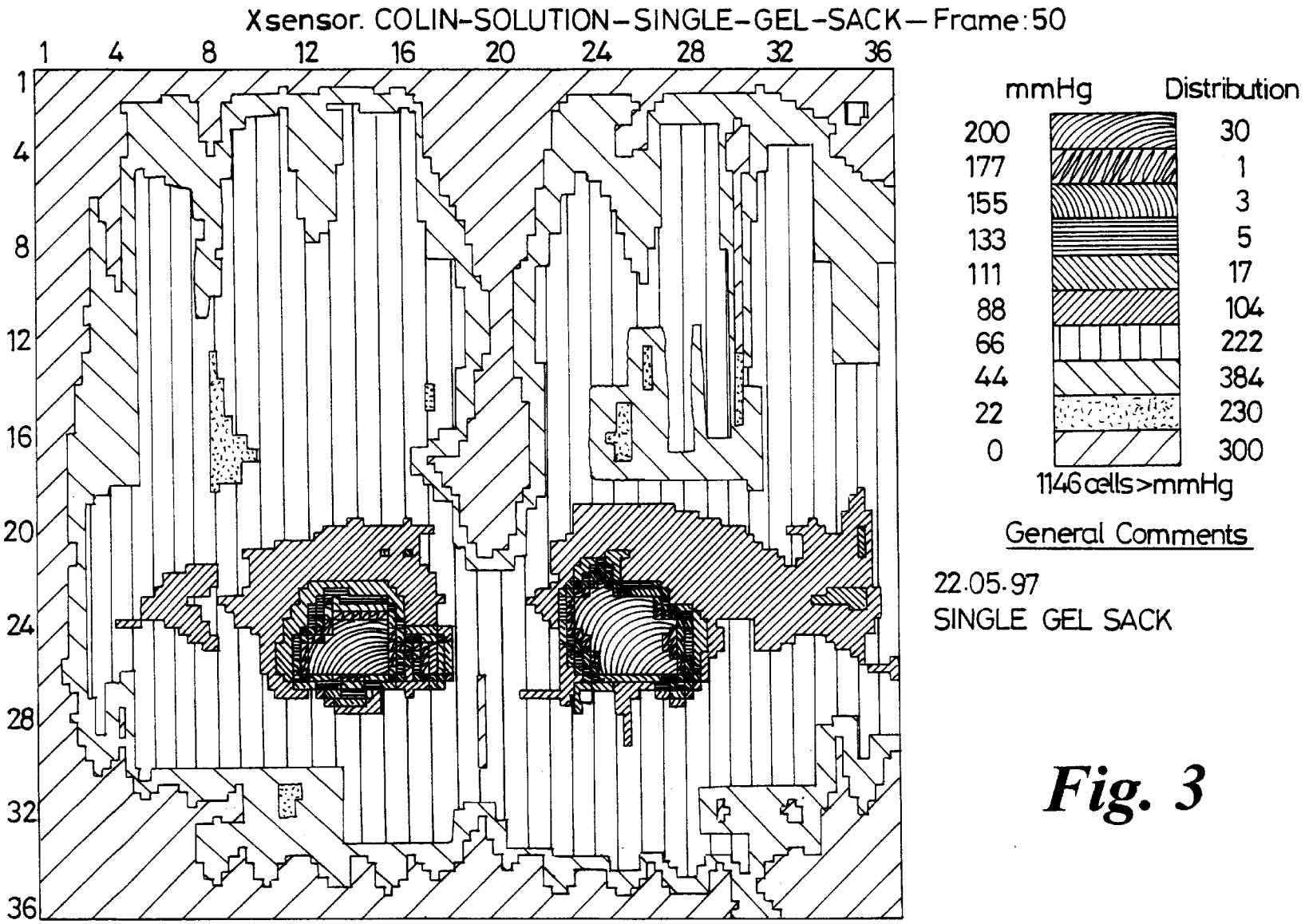
FIG. 3 shows the pressure pattern produced when a user sits on a prior art cushion having a single gel sac.
Figure 4:
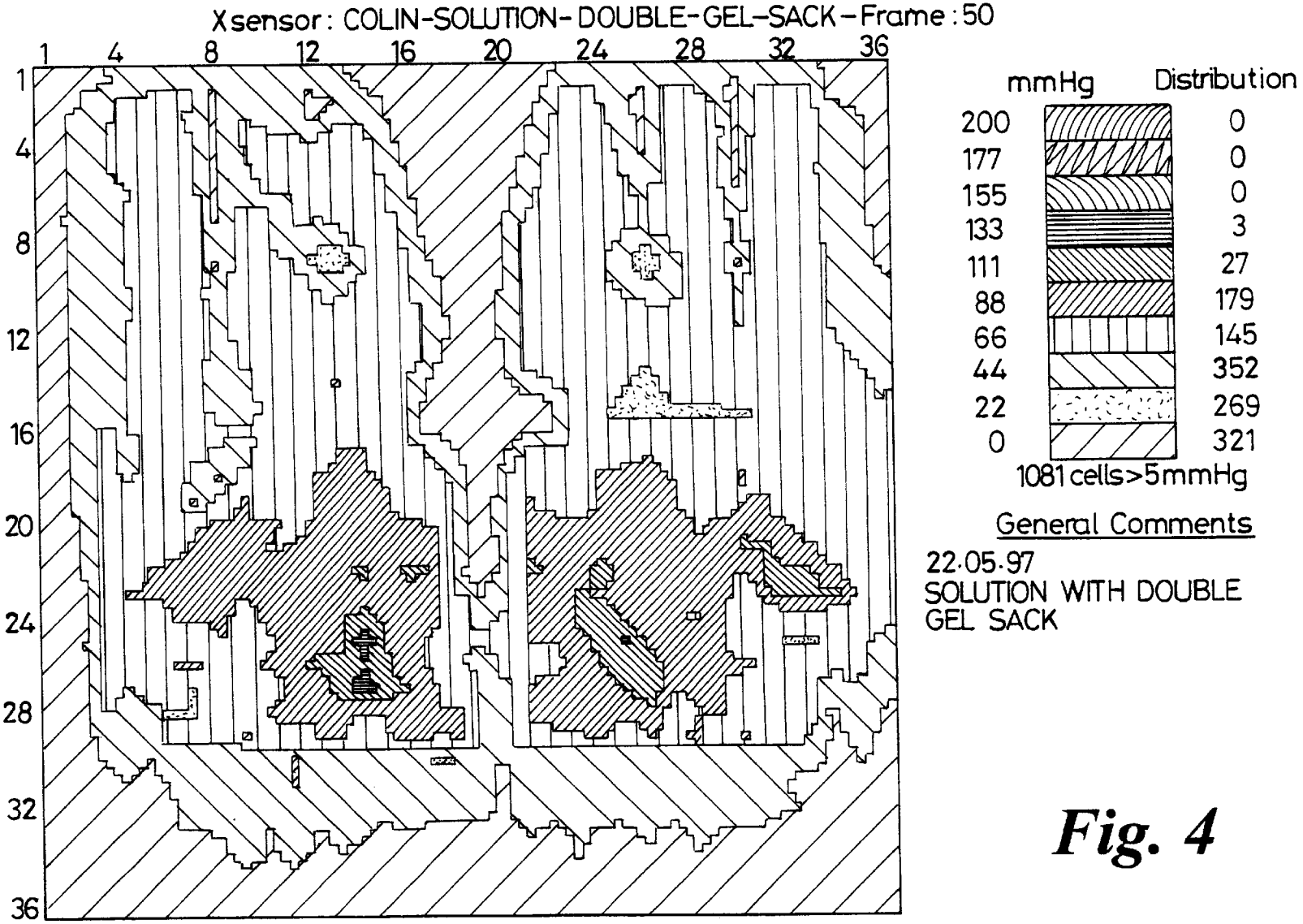
FIG. 4 is the corresponding pattern for the cushion of FIGS. 1 and 2.

In FIGS. 3 and 4 the difference between the performance of a single gel sac and a double gel sac is shown. The red areas in FIG. 4 illustrate areas of significant pressure in the region of the ischial tuberosities.

I claim:

1. A pressure relief cushion comprising a foam base defining a cavity in its rear section opening into its upper surface and extending over that part of the cushion which in use underlies the ischial tuberosities of the user; a single gel sac disposed in the cavity to substantially fill the cavity; and a gel overlay connected to the sac, but not in gel communication with it, the overlay further extending over the front section of the cushion.

2. A cushion as claimed in claim 1 wherein the overlay is provided with restrictions to inhibit the flow of gel through the overlay.

3. A cushion as claimed in 1 wherein the cushion is 7 to 9 cms in depth.

4. A cushion as claimed in 1 wherein the cavity is between 4.5 and 5.5 cms deep at its deepest point.

5. A cushion as claimed in 1 wherein the foam is resilient.

6. A cushion as claimed in claim 1 wherein the foam of the front section is shaped to provide pressure relieving areas.

7. A cushion as claimed in claim 1 wherein the overlay is thin as compared with the gel sac.

8. A cushion as claimed in claim 7 wherein the overlay is less than 1 cm deep and the gel sac has a maximum depth of 5.5 cm.

* * * * *